US006601413B1

(12) United States Patent
Vito

(10) Patent No.: US 6,601,413 B1
(45) Date of Patent: Aug. 5, 2003

(54) HASP ENCLOSURE FOR RECEIVING A LOCK

(76) Inventor: Robert A. Vito, 1434 Sugartown Rd., Berwyn, PA (US) 19312

( * ) Notice: Subject to any disclaimer, the term of this patent is extended or adjusted under 35 U.S.C. 154(b) by 0 days.

(21) Appl. No.: 10/056,871

(22) Filed: Jan. 24, 2002

(51) Int. Cl.[7] ..... E05B 67/38

(52) U.S. Cl. ..... 70/56; 70/158; 70/DIG. 56; 70/DIG. 43

(58) Field of Search ..... 70/54–56, 158, 70/DIG. 56, 2, DIG. 43, 203, 212, 159; 292/286, 330, DIG. 32, 327, DIG. 53; 16/247, 249

(56) References Cited

U.S. PATENT DOCUMENTS

| | | | | | |
|---|---|---|---|---|---|
| 231,935 | A | * | 9/1880 | Sang | 16/249 |
| 1,764,367 | A | | 6/1930 | Szymanski | |
| 2,660,872 | A | | 12/1953 | Beach | 70/32 |
| 2,766,605 | A | * | 10/1956 | O'Brien | 70/8 |
| 3,157,040 | A | | 11/1964 | Raye | |
| 3,834,195 | A | | 9/1974 | Winkhaus | 70/8 |
| 3,901,058 | A | | 8/1975 | Best | 70/32 |
| 3,995,459 | A | | 12/1976 | Weeks et al. | 70/13 |
| 4,026,132 | A | | 5/1977 | Best | 70/9 |
| 4,269,048 | A | | 5/1981 | McDorman | 70/13 |
| 4,322,102 | A | * | 3/1982 | Lindblom | 292/281 |
| 4,535,612 | A | | 8/1985 | Seremet | 70/56 |
| 4,566,296 | A | | 1/1986 | Kochakis | 70/56 |
| 4,835,996 | A | * | 6/1989 | Loughlin et al. | 70/53 |
| 4,843,845 | A | | 7/1989 | Poe | 70/54 |
| 4,852,920 | A | | 8/1989 | Deforrest, Sr. | 292/205 |
| 4,896,518 | A | * | 1/1990 | Appelgren | 70/54 |
| 4,972,689 | A | * | 11/1990 | Anderson | 70/56 |
| 4,977,763 | A | * | 12/1990 | Sewell | 70/54 |
| 5,035,127 | A | * | 7/1991 | Larsen | 70/56 |
| 5,172,574 | A | | 12/1992 | Perfetto | 70/56 |
| 5,174,135 | A | | 12/1992 | Loughlin | 70/2 |
| 5,321,961 | A | * | 6/1994 | Barberi | 70/56 |
| 5,426,959 | A | * | 6/1995 | Kies | 70/56 |
| 5,743,118 | A | * | 4/1998 | Anderson | 70/56 |
| 5,878,604 | A | * | 3/1999 | Stone et al. | 70/56 |
| 6,058,745 | A | * | 5/2000 | Sanchez | 70/56 |
| D439,826 | S | | 4/2001 | Oddy | D8/336 |
| 6,357,266 | B1 | * | 3/2002 | Van Buren | 70/56 |
| 6,439,008 | B1 | * | 8/2002 | Keil | 70/56 |
| 6,463,769 | B1 | * | 10/2002 | Garner | 70/56 |

* cited by examiner

*Primary Examiner*—Anthony Knight
*Assistant Examiner*—John B. Walsh
(74) *Attorney, Agent, or Firm*—Volpe and Koenig, P.C.

(57) ABSTRACT

A hasp enclosure for protecting an eye of a hasp and receiving a lock. The hasp enclosure includes a cover having an opening which extends into an interior, eye receiving chamber. An aperture is defined through the cover which intersects the interior, eye receiving chamber in a location which is aligned with the eye so that the lock can be be inserted through the aperture in the cover and the eye. The cover may be a separate piece or may be connected to the hasp face plate over the hasp eye receiving slot.

6 Claims, 4 Drawing Sheets

HASP ENCLOSURE FOR RECEIVING A LOCK

BACKGROUND

The present invention is related to an anti-theft device. More particularly, the invention is directed to a hasp enclosure which provides protection for the hasp eye from breaking or cutting, while still allowing insertion of a lock.

Hasps are typically used for locking two elements together. Typically, the two elements consist of a moveable element which is to be held in a fixed position relative to a second element, which may be fixed or moveable, in order to prevent opening of the moveable element. The common hasp has two parts. The first part is generally comprised of a hasp eye which is connected to one of the two elements. The second part is a latch portion that which is connected to the other of the two elements. The latch portion typically includes a face plate with a hasp eye receiving slot. The face plate maybe fixed directly to the other of the two elements or may be connected to a mounting plate which is in turn connected to the other of the two elements so that the face plate can be pivoted into and out of position over the eye without moving the moveable element relative to the second element. Typical uses are for locking a door, a cupboard, a gate or the like in a closed position.

Typically a padlock or other type of lock is inserted through the hasp eye in order to lock the face plate in position. However, the hasp eye is typically exposed and an unauthorized person can use a pair of bolt cutters and simply snip the hasp eye. It is also possible for an unauthorized user to attempt to cut the shank of the lock if it is exposed. However, typically such locks have hardened shanks which are difficult to cut through using mechanical means. The unauthorized person will then typically cut or break the exposed hasp eye such that the lock can be removed without being unlocked.

The present invention is directed to an easily useable system for protecting the hasp eye from cutting or damage by unauthorized persons, and may be connected to existing hasp installations to provide extra protection.

SUMMARY

Briefly stated, the present invention provides a hasp enclosure for protecting an eye of a hasp and receiving a lock. The hasp enclosure includes a cover having an opening which extends into an interior, eye receiving chamber. An aperture is defined through the cover which intersects the interior, eye receiving chamber in a location which is adapted to be aligned with the eye so that the lock is adapted to be inserted through the aperture in the cover and the eye.

Preferably, the cover is formed from hardened steel or another suitably hard material, and may be manufactured as a welded box having five side panels which defined the chamber, with the aperture extending through two opposing side panels. The aperture is preferably located at a predetermined distance from the opening that is less then a depth of the hasp eye so that the lock is adapted to secure the cover to the eye.

In another aspect, the cover is connected to the face plate of the hasp over the eye receiving slot in the face plate. This may be utilized when the attachment holes are provided directly in the face plate or if the face plate is connected by a hinged connection to a mounting plate.

In another aspect, the invention provides a hasp assembly. The hasp assembly includes an eye adapted to be connected to a first structure and a latch portion to be connected to a second structure. The latch portion includes a face plate with an eye receiving slot, and a cover having an opening which extends into an interior, eye receiving chamber connected to the face plate over the slot. An aperture is defined through the cover which intersects the interior, eye receiving chamber in a location which is aligned with the eye when the eye is received through the slot so that a lock can be inserted through the aperture in the cover and the eye.

Preferably, the cover is formed of hardened steel or another suitable hard material, and may be manufactured as a welded box having five side panels which define the chamber, with the aperture extending through two opposing side panels. Alternatively, the cover may be machined or forged and heat treated or tempered in order to achieve the desired strength. The aperture is preferably located at a predetermined distance from the opening that is less then the depth of the eye. In a preferred embodiment, the face plate is pivotally connected to a mounting plate.

BRIEF DESCRIPTION OF THE DRAWINGS

The foregoing summary as well as the following detailed description of the preferred embodiment of the present invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE PREFERRED EMBODIMENTS

Figure 1:
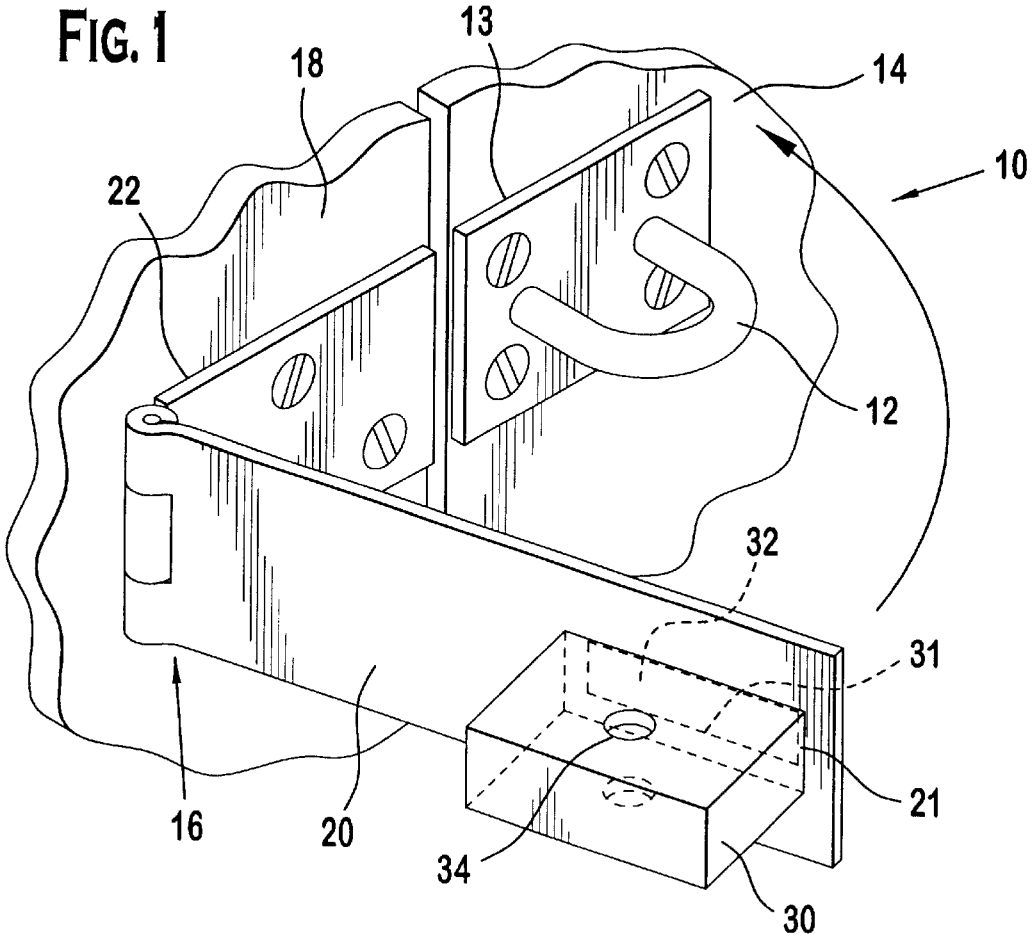
FIG. 1 is a perspective view of a first preferred embodiment of a hasp assembly with an enclosure for protecting an eye of a hasp shown in a first, open position.

Certain terminology is used in the following description for convenience only and is not considered limiting. The words "right," "left," "lower," and "upper" designate directions in the drawings to which reference is made. This terminology includes the words specifically noted above, derivatives thereof, and words of similar import.

Figure 2:
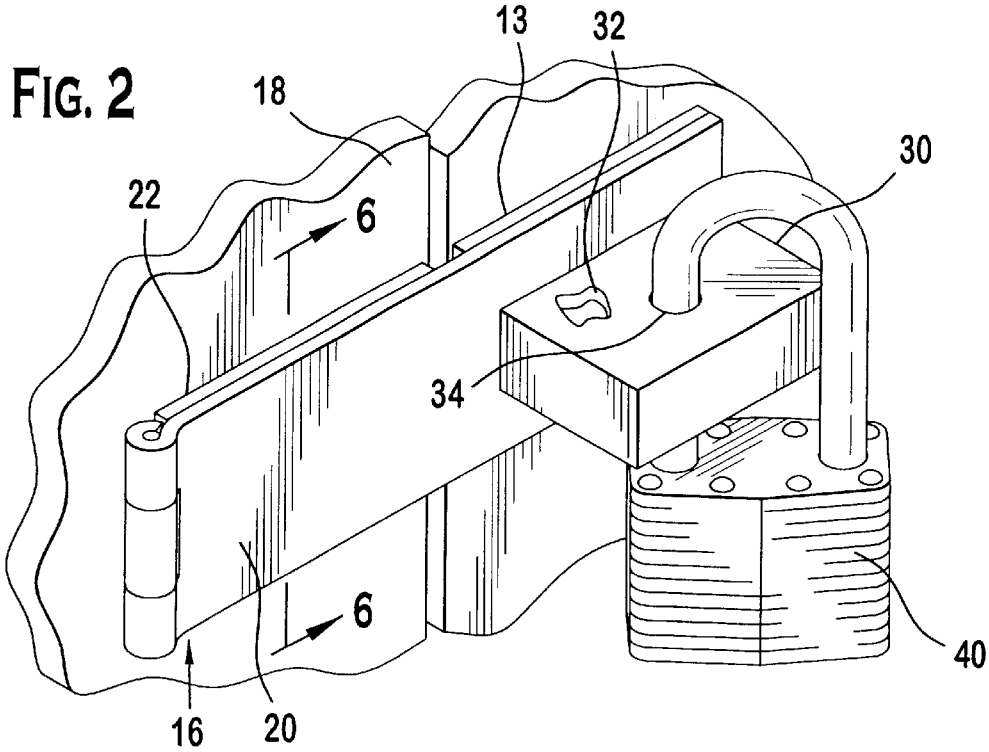
FIG. 2 is a perspective view of the hasp assembly of FIG. 1 shown in a second, locked position.

Referring now to FIGS. 1 and 2, a hasp assembly 10 in accordance with present invention is shown. The hasp assembly 10 includes an eye 12 which is adapted to be connected to a first structure 14 and latch portion 16 that is adapted to be connected to a second structure 18. The latch portion 16 includes a face plate 20 which may be directly mounted to the second structure 18, or maybe pivotably mounted to a mounting plate 22 which is connected to the second structure 18. The face plate 20 includes an eye receiving slot 24 through which the hasp eye 12 passes in order to close and lock the hasp 10.

A cover 30 having an opening 32 which extends to an interior, eye receiving chamber 34 is connected to face plate 20 over the slot 24. An aperture 34 is defined through the cover 30 and intersects the interior, eye receiving chamber 32 in a location which is aligned with eye 12 when the eye 12 is received through the slot 24 so that a lock 40 can be inserted through the aperture in the cover 30 and the eye 12.

Figure 6:
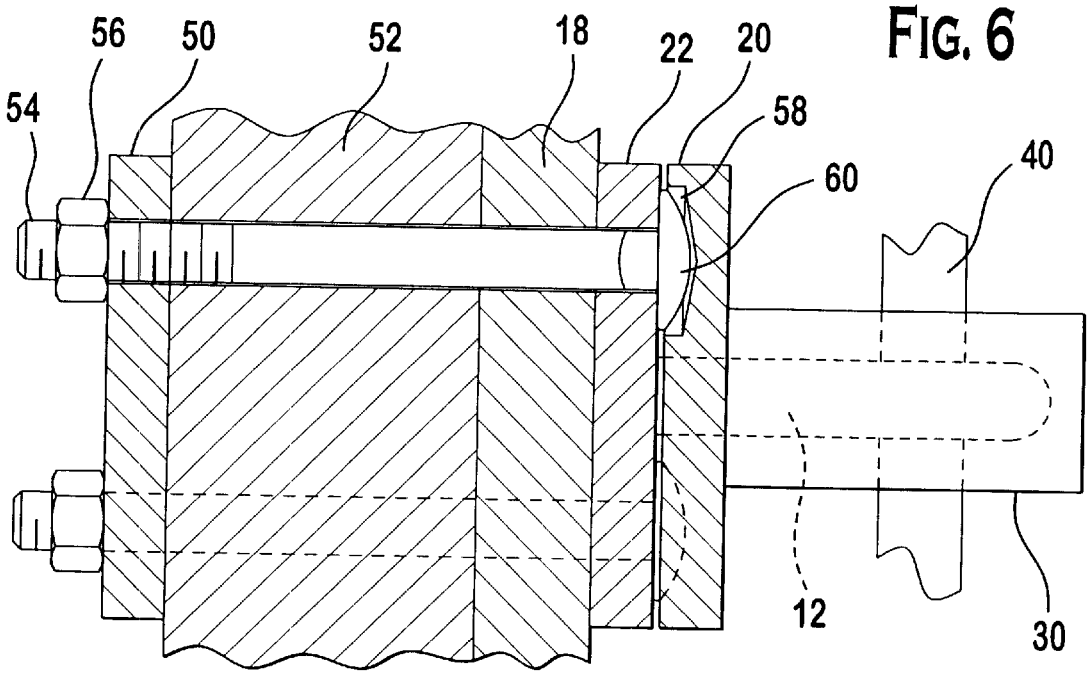
FIG. 6 is a cross-sectional view through another preferred embodiment of a face plate similar to that shown in FIG. 2 taken in a location similar to that shown by the lines 6—6 in FIG. 2.
Figure 7:
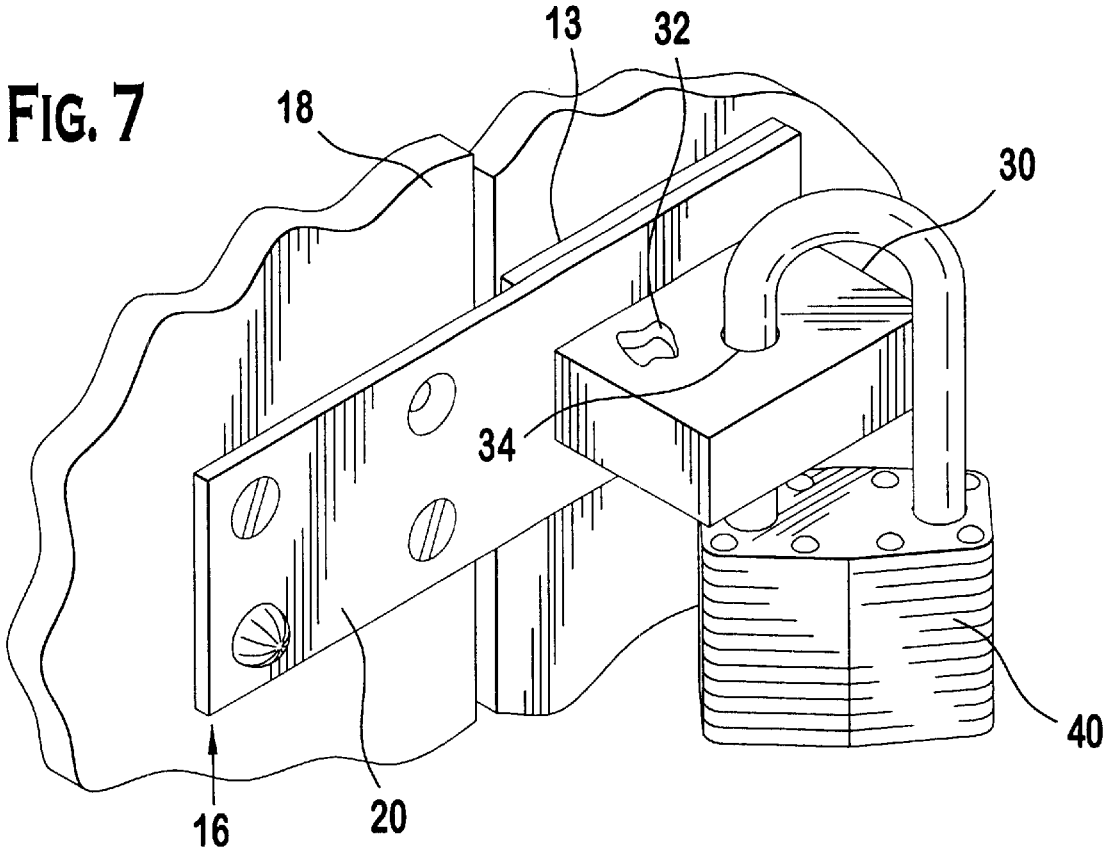
FIG. 7 is a perspective view of a hasp assembly according to the present invention.

As shown in FIG. 1, preferably the eye 12 is bolted or otherwise fastened to the first structure 14 and face plate 20, or the mounting plate 22 connected thereto is bolted to second structure 18. Referring to FIG. 6, backing plates 50 maybe utilized on the opposite side of a strut 52 which supports one of the first and second structures 14, 18, if desired, in order to provide a more secure mounting. Depending on the material and thickness of the first or second structure 14, 18, the backing plates 50 can be used without having the bolts 54 also extend through a stud 52. When using a backing plate 50, bolts 54 preferably extend through the stud 52 and are secured through the backing plate 50 via nuts 56. It is preferable that the inner surface of the face plate 20 have cavities 58 configured to receive bolt heads 60. The cavities 60 allow larger bolts 54 to be used while still allowing the face plate 20 to be properly placed in the closed position. Other attachment means, such as welding may also be utilized, depending upon the material of the first and second structures, 14, 18.

Figure 5:
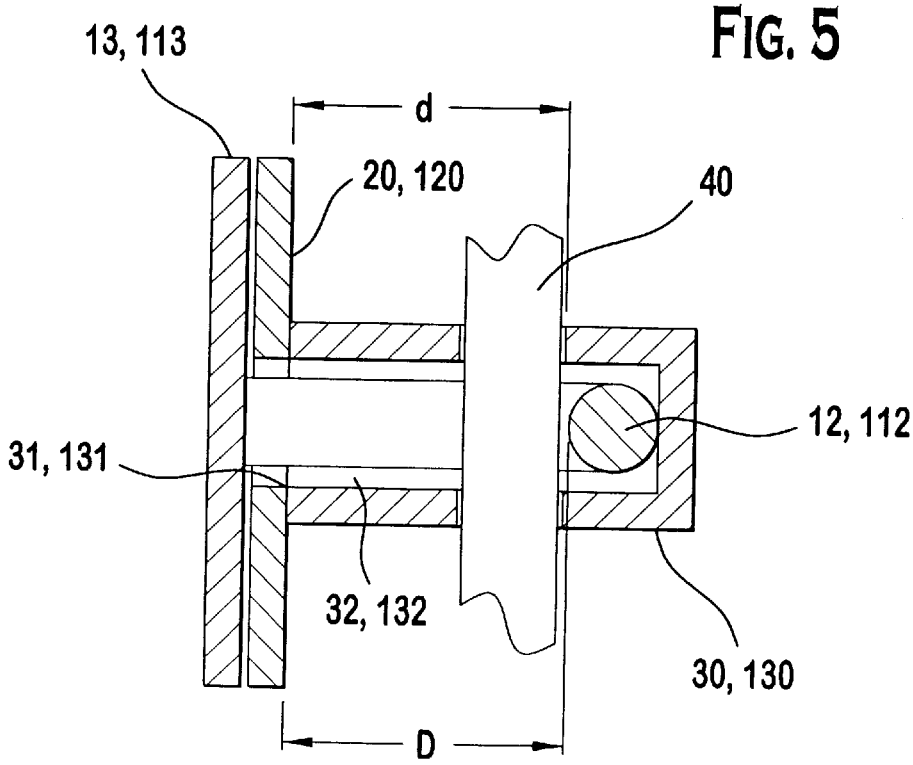
FIG. 5 is a cross-sectional view through the hasp enclosures in accordance with present invention showing the position of an installed lock shank relative to the hasp eye depth.

Referring again to FIG. 1, the cover 30 is preferably formed as a welded box having five side panels which define the chamber 32. The aperture 34 extends through two opposing side panels, as indicated in FIG. 1. The cover 30 is preferably hardened to resist cutting or damage. The cover 30 may also be formed by machining, forging or casting a suitable metallic material, or from a suitable composite or polymeric material having the required strength. Preferably, as shown in detail in FIG. 5, the aperture 34 is located at a predetermined distance d from the opening 31 of the cover 30 that is less then a depth D of the eye 12. Preferably, the difference between D and d is less than 0.10 inches in order to prevent slack movement of the face plate 20 and cover 30 away from the mounting plate 13 for the eye. This prevents an unauthorized person from attempting to cut the eye in a position between the face plate 20 and the mounting plate 13.

While the first preferred embodiment of the hasp 10 provides the cover 30 connected to a face plate 20, it is also possible to provide a hasp enclosure in accordance with the present invention for use with an existing hasp assembly which did not include a cover.

Figure 3:
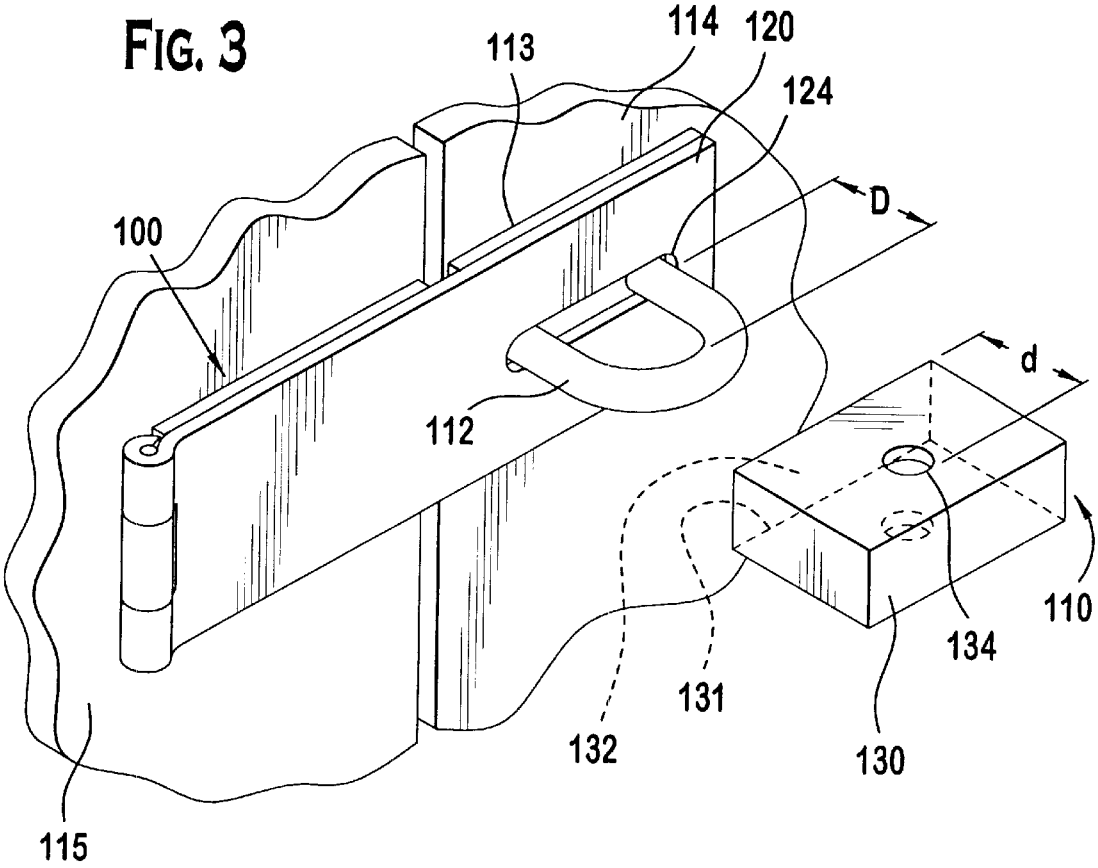
FIG. 3 is a perspective view of a second embodiment of a hasp enclosure for protecting an eye of an hasp shown being installed over a hasp eye.

Referring now to FIG. 3, a second preferred embodiment of the invention is shown. In FIG. 3, a hasp enclosure 110 for protecting an eye 112 of a hasp assembly 100 is shown. The hasp enclosure 110 includes a cover 130 having an opening 131 which extends into an interior, eye receiving chamber 132. The eye receiving chamber 132 is dimensioned to accommodate the eye 112 of the hasp 100. An aperture 134 is defined through the cover 130 which intersects the interior, eye receiving chamber 132 in a location which is adapted to be aligned with the eye 112 so that a lock can be adapted to be inserted through the aperture 134 in the cover 130 and the eye 112.

Preferably, the cover 130 is formed as a welded steel box having five side panels which defined the chamber 132. The aperture 134 extends through two opposing side panels. Alternatively, the cover 130 may be machined from a solid piece of material or cast or forged into the desired shape. Preferably, the cover 130 is made of a hardened steel. However, other cut and impact resisting materials may be utilized.

As shown in FIG. 3, the aperture 134 is located at a predetermined distance d from the opening 131 that is less than a depth D of the hasp eye 112 so that the lock is adapted to secure the cover 130 to the eye 112 to prevent movement of the face plate 120 of the hasp in order to prevent an unauthorized person from moving the face plate 120 in order to access the eye 112 in a position between the face plate 120 and the mounting plate 113 for the eye. Preferably, the opening 131 in the cover 130 has the same size as the slot 124 in the face plate 120. Covers 130 of various sizes may be produced to fit the standard size hasp assemblies 100, and the depth d may be set as a defined parameter in sizing the cover 130. Accordingly, multiple different sizes of hasp covers 130 may be produced and marketed for existing hasp assemblies 100.

Figure 4:
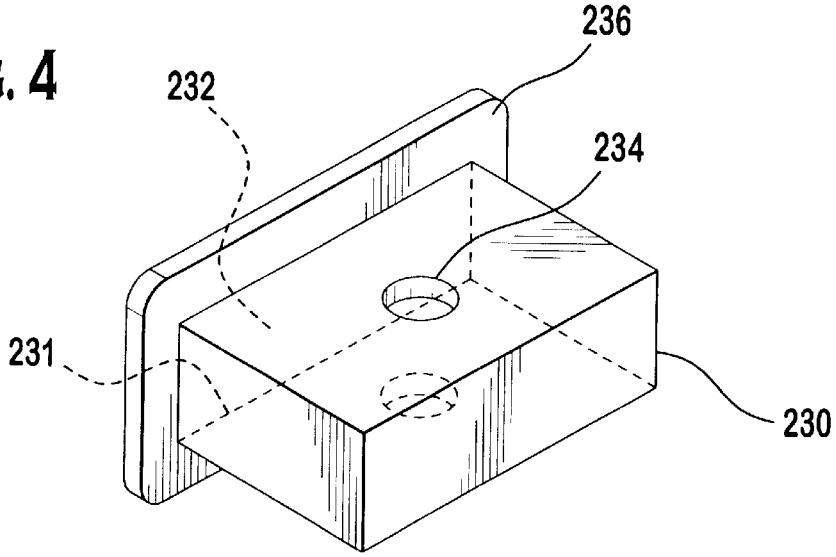
FIG. 4 is a perspective view of a third embodiment of a hasp enclosure for protecting an eye of an hasp similar to the embodiment of FIG. 3.

Referring now to FIG. 4, a third preferred embodiment of an hasp cover 230 is shown. The third embodiment of the hasp cover 230 is similar to the second preferred embodiment 130 and includes an opening to 231 which leads into an interior, eye receiving chamber 232. The aperture 234 is defined through the cover 230. In the third preferred embodiment, a flange 236 is connected to the covered 230 around the opening 231 in order to provide a wider base to accommodate different size slots in hasp face plate. This also provides additional support prevent canting or titling of the cover 230.

In both the second and third embodiments of the hasp cover 130, 230, the depth d of the aperture 134, 234 becomes more critical in order to maintain the hasp cover 130, 230 locked in position. This enhances the effectiveness of the hasp cover 130, 230 as a theft and/or damage deterrent. While a preferred difference in length between the d and D is less than 0.10 inches, greater sizes could be utilized, depending upon the particular application and the overall size of the hasp.

Each of the embodiments of the invention provides for superior protection of the hasp eye 12, 112. The hasp cover 30, 130, 230 in accordance with present invention may be used with various types of locks, including padlocks and pin locks. When a pin lock is used, this provides additional protection since the shank of the lock is also not exposed in the area that extends through the aperture 34, 134, 234 in the cover 30, 130, 230.

While the preferred embodiments of the invention have been described in detail, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. A hasp enclosure for protecting an eye of a hasp and receiving a lock, comprising:

a cover having an opening which extends into an interior, eye receiving chamber;

an aperture defined through the cover which intersects the interior, eye receiving chamber in a location which is adapted to be aligned with the eye so that the lock is adapted to be inserted through the aperture in the cover and the eye; and a face plate with a hasp eye receiving slot, the cover being connected to the face plate over the slot, wherein the slot has the same size as the opening in the cover.

2. The hasp enclosure of claim 1, wherein tie cover is formed as a welded box having five side panels which define the chamber, and the aperture extends through two opposing side panels.

3. The hasp enclosure of claim 1, wherein the aperture is located at a predetermined distance from the opening that is less than a depth of the hasp eye so that the lock is adapted to secure the cover to the eye.

4. The hasp enclosure of claim 1, wherein the face plate has an inner surface having at least one cavity for receiving a bolt head.

5. The hasp enclosure of claim 1, wherein attachment holes are located in the face plate.

6. The hasp enclosure of claim 1, wherein the face plate is pivotably connected to a mounting plate.

* * * * *